US006351973B1

(12) United States Patent
McClain et al.

(10) Patent No.: US 6,351,973 B1
(45) Date of Patent: Mar. 5, 2002

(54) INTERNAL MOTOR DRIVE LIQUID CARBON DIOXIDE AGITATION SYSTEM

(75) Inventors: James B. McClain, Raleigh; Gary C. Schrebe, Wake Forest, both of NC (US)

(73) Assignee: MiCell Technologies, Inc., Raleigh, NC (US)

( * ) Notice: Subject to any disclaimer, the term of this patent is extended or adjusted under 35 U.S.C. 154(b) by 0 days.

(21) Appl. No.: 09/497,308

(22) Filed: Feb. 3, 2000

Related U.S. Application Data

(60) Provisional application No. 60/118,708, filed on Feb. 4, 1999.

(51) Int. Cl.[7] ..... D06F 43/02
(52) U.S. Cl. ..... 68/140; 134/120
(58) Field of Search ..... 68/140; 134/119, 134/120

(56) References Cited

U.S. PATENT DOCUMENTS 4,114,406 A * 9/1978 Horowitz et al. ..... 68/140 X
5,267,455 A 12/1993 Dewees et al. ..... 68/5 C
5,467,492 A 11/1995 Chao et al. ..... 8/159
5,669,251 A 9/1997 Townsend et al. ..... 68/58
5,850,747 A 12/1998 Roberts et al. ..... 68/15
5,943,721 A 8/1999 Lerette et al. ..... 8/158
5,970,554 A 10/1999 Shore et al. ..... 8/158
6,122,941 A * 9/2000 McClain et al. ..... 68/140 X

FOREIGN PATENT DOCUMENTS

WO WO 97/33031 9/1997

OTHER PUBLICATIONS

6–Inch Submersible Motors, *Product Data* by Franklin Electric, 6 pages (1996–1998).

* cited by examiner

*Primary Examiner*—Philip R. Coe
(74) *Attorney, Agent, or Firm*—Myers, Bigel, Sibley & Sajovec, P.A.

(57) ABSTRACT

A cleaning apparatus adapted for use with a carbon dioxide cleaning medium comprises a body member, a door connected to the body member and together with the body member forming a pressure vessel, a basket disposed within the body member, a motor contained within the pressure vessel, and a drive mechanism contained within the pressure vessel for rotating the basket with the motor. Because the motor and drive mechanism are both contained within the pressure vessel, the need for a rotating shaft that penetrates the pressure vessel, and which must be sealed at least in part against the high pressure liquid contained therein, is obviated.

20 Claims, 1 Drawing Sheet

INTERNAL MOTOR DRIVE LIQUID CARBON DIOXIDE AGITATION SYSTEM

RELATED APPLICATIONS

This application claims priority from J. McClain et al., U.S. Provisional Application No. 60/118,708, filed Feb. 4, 1999, the disclosure of which is incorporated by reference herein in its entirety.

FIELD OF THE INVENTION

The present invention concerns apparatus for cleaning fabrics, garments and the like in liquid carbon dioxide, which apparatus includes a rotating basket.

BACKGROUND OF THE INVENTION

Numerous different apparatus for washing garments and fabrics are known. Examples of patents on washing machines include U.S. Pat. No. 1,358,168 to McCutchen, U.S. Pat. No. 1,455,378 to Allen, U.S. Pat. No. 2,357,909 to Ridge, U.S. Pat. No. 2,816,429 to Kurlancheek, and U.S. Pat. No. 3,444,710 to Gaugler. Such apparatus is, in general, adapted to home use with water-based cleaning systems.

Non-aqueous cleaning apparatus, known as "dry cleaning" apparatus, is also known. Dry cleaning employs an organic solvent such as perchloroethylene in place of an aqueous system. Dry cleaning apparatus is not, in general, employed in the home, and is instead situated at a store or central plant. Problems with convention dry-cleaning systems include the toxic nature of the solvents employed.

Carbon dioxide has been suggested as a dry cleaning medium. See, e.g., U.S. Pat. No. 4,012,194 to Maffei. To date, however, a feasible apparatus for carrying out carbon dioxide cleaning has not been provided. One apparatus is described in U.S. Pat. No. 5,467,492 to Chao et al. This apparatus has apparently been supplanted by the apparatus described in U.S. Pat. No. 5,669,251 to Townsend et al. Townsend describes a dry cleaning system having a hydraulically rotated basket that rests on roller bearings. The system is adapted to use with liquid carbon dioxide. Manifolds are disposed between an outer pressure vessel and the basket and have nozzles that produce jets of liquid carbon dioxide that agitate the garments. The basket is said to be rotated by the friction of the garments against the basket walls (column 4, lines 47–48) or by a paddle wheel or turbine (col. 5, lines 8–9). A disadvantage of Townsend is that the basket is supported by roller bearings around the periphery of the basket, which are complex and prevent simple removal of the basket for cleaning, inspection, etc. A further disadvantage of Townsend is that roller bearings are required between the basket side wall and the side wall of the pressure vessel. Since roller bearings are relatively large, this increases the "dead space" between the side wall of the basket and the side wall of the pressure vessel, which dead space must be filled with liquid that is not operating to clean clothing within the basket.

U.S. Pat. No. 5,267,455 to Dewees et al. describes a dry cleaning system in which carbon dioxide as a cleaning medium is transferred between vessels by means of a second purge gas such as nitrogen. The use of multiple pressurized gases makes the system considerably more complex. The system employs a rotating basket, but a disadvantage is that the basket is rotated by means of a magnet coupling. Magnetic couplings provide an inefficient drive means for a rotating basket.

U.S. Pat. No. 5,850,747 to Roberts and Kegler describes a liquified gas dry-cleaning system with a pressure vessel temperature compensating compressor. No means of driving a basket within the vessel is suggested.

SUMMARY OF THE INVENTION

A cleaning apparatus adapted for use with a carbon dioxide cleaning medium comprises a body member, a door connected to the body member and together with the body member forming a pressure vessel, and a basket disposed within the body member. The basket is supported with a rotating shaft. A motor is contained within, rather than outside, the pressure vessel, and a drive mechanism is also contained within the pressure vessel for rotating the basket with the motor. Because the motor and drive mechanism are both contained within the pressure vessel, the need for a rotating shaft that penetrates the pressure vessel, and which must be sealed at least in part against the high pressure liquid contained therein, is obviated.

More particularly, an apparatus of the invention comprises:

- a body member having a front opening formed therein, the body member having side walls and a back wall opposite the front opening, the side walls terminating in a front body member edge portion defining the front opening;
- a door connected to the body member, the door having a front wall and side walls, with the side walls terminating in an inner edge portion configured to abut the body member edge portion; the body member and the door together forming an enclosed pressure vessel;
- a substantially cylindrical basket disposed within the body member for rotation about a generally horizontal axis, the basket having a front opening formed therein, the basket having a side wall and a back wall opposite the front opening, the side wall terminating in a front basket edge portion defining the basket front opening;
- an elongate shaft connected to the basket back wall and coincident with the axis, and
- a shaft support connected to the body member back wall, with the shaft disposed in the shaft support to permit rotation of the basket within the body member without the shaft penetrating through the back wall;
- a motor contained within the pressure vessel; and
- a drive mechanism interconnecting the motor to the elongate shaft and configured to rotate the basket.

The foregoing and other objects and aspects of the present invention are explained in the drawings herein and the specification set forth below.

DETAILED DESCRIPTION OF PREFERRED EMBODIMENTS

The present invention is explained by comparing the device described in connection with FIG. 1 with the device described in connection with FIG. 2.

Figure 1:
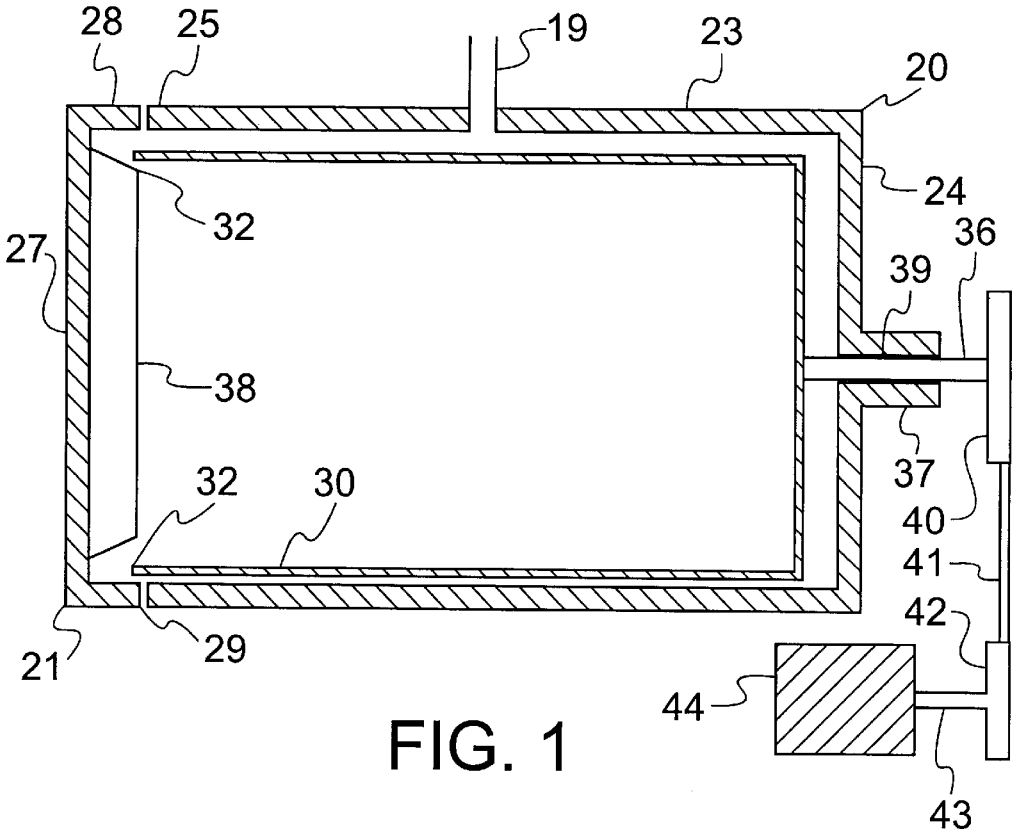
FIG. 1 is a side-sectional view of a dry cleaning apparatus in which the basket is supported by a rotating shaft, which shaft is driven by an external motor.

As shown in FIG. 1, a wash tank has a body member 20 and a door member 21, which in these figures is shown in a closed and sealed position to provide an enclosed pressure vessel having an inner chamber formed therein. The body member has a front opening 22 formed therein, side walls 23 and a back wall 24 opposite the front opening. The side walls terminate in a front body member edge portion 25 that defines the front opening. The edge portion serves in the sealing mechanism, as discussed below. The door has a front wall 27 and side walls 28, with the side walls terminating in an inner edge portion 29 configured to abut the body member edge portion. A fill line 19 for the carbon dioxide cleaning medium is connected to the body member at the top thereof.

The door inner edge portion and the body member edge portion together comprise a seal for sealing the door and body member to form an enclosed pressure vessel. A lock mechanism may be connected to the body member and configured to sealably connect the body member outer edge portion with the door inner edge portion when the door is in a closed position.

A substantially cylindrical basket 30 is disposed within the body member for rotation about a generally horizontal axis. The basket is preferably perforated. The basket has a front opening formed therein, and has a side wall 33 and a back wall 34 opposite the front opening. The basket side wall terminates in a front basket edge portion 32 defining the basket front opening. Note that the basket front edge portion 32 is spaced forward from the body member edge portion 25 when the basket is positioned in the body member. This serves to prevent loose garments or materials placed within the basket from becoming caught in the seal formed between edge portions 25 and 29 and interfering with seal integrity. While a generally horizontal basket is illustrated and preferred, it will be appreciated that the basket may be oriented in other positions, and may even be oriented in a generally vertical position.

An elongate shaft 36 is connected to the basket back wall. The shaft is coincident with the axis of rotation of the basket. A shaft support in the form of a bearing cartridge holder 37 is connected to the body member back wall. The shaft is disposed in the bearing cartridge 39 that is disposed within cartridge holder 37 to permit rotation of the basket within the body member.

A plug 38 is connected to the door, the plug having a surface portion configured to abut the basket front opening when the door is in a closed position, as illustrated, to permit rotation of the basket within the body member while preventing items within the basket from escaping during rotation of the basket.

The shaft is connected to a gear 40, which is in turn connected via a drive chain 41 to gear 42, which is in turn mounted on the shaft 43 of an external electric motor 44. The advantage of such a system is the positive drive connection, which permits satisfactory rotation of the basket when it is loaded with clothes and filled with liquid carbon dioxide cleaning medium. A disadvantage, however, is that liquid carbon dioxide (or other compressed gas cleaning medium) can seep through the bearing cartridge and any associated seals. Accordingly, it would be desireable to provide a drive system in which the shaft did not need to penetrate through the vessel wall. Systems suggested to date, such as magnetic couplings, jet drives, and turbine drives, are not entirely satisfactory.

Figure 2:
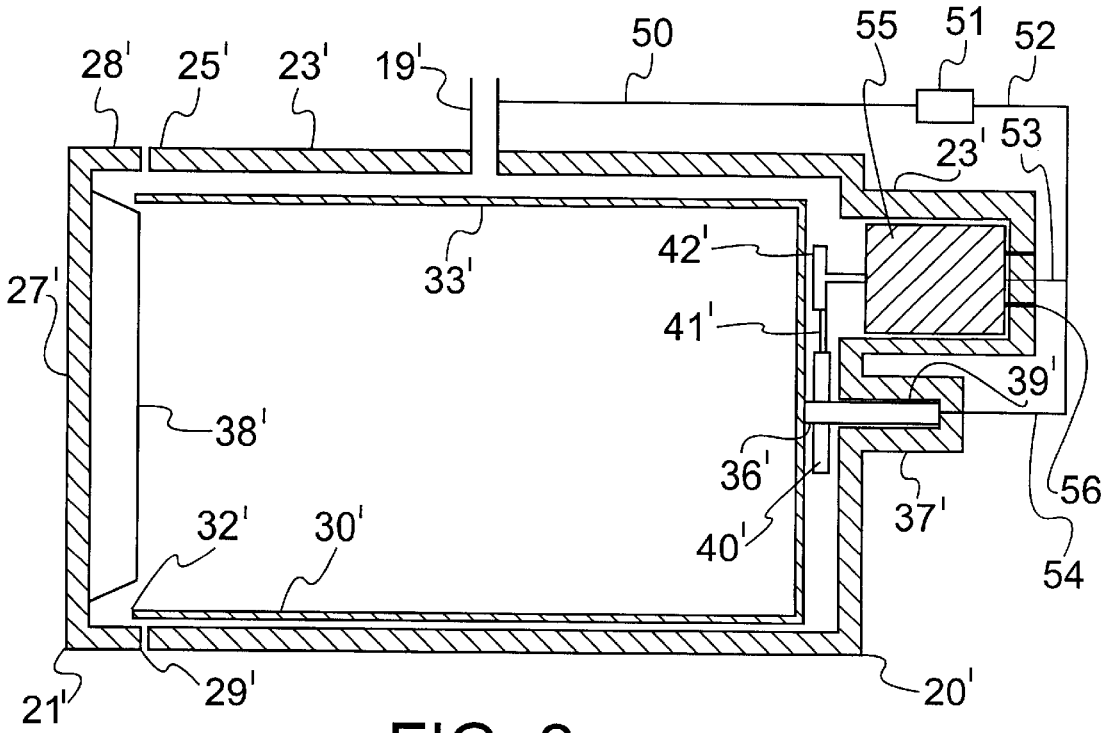
FIG. 2 is a side-sectional view of a cleaning apparatus of the invention, in which the rotating basket is supported by a shaft, which shaft does not pass through the pressure vessel, and which shaft is rotated by a motor contained within the pressure vessel.

A solution to these problems is disclosed in FIG. 2. Parts in FIG. 2 that are analogous to parts in FIG. 1 are assigned like numbers. As will be seen, the motor is enclosed within the pressure vessel, rather than disposed outside thereof A carbon dioxide cleaning medium side-stream line 50, or flush line, is connected to filter 51 and flows through line 52 to the motor flush line 53 and the bearing flush line 54. It will be noted that the motor 55 is mounted within the pressure vessel (by means of fasteners 56) and that the shaft 36' need not, and does not, penetrate through the bearing cartridge holder 37'. Hence, essentially all leaking around the rotating shaft is obviated. Indeed, it becomes a simple matter to flush the bearing by means of the flush line 54. The flush line is shown connected directly to the file line, but could be indirectly connected through a common source or the like. It is advantageous to flush the bearing with the same solution as the wash medium because contamination of the wash medium with other fluids is thereby obviated. The chain and gears 40', 41', 42' together serve as a drive mechanism, which is contained within the enclosed pressure vessel.

In general, the drive mechanism may be provided as illustrated above, by gears alone, or as a gear assembly operating as a transmission for altering the speed or reversing the direction of the basket. A mechanical or electromagnetic shifting mechanism could be incorporated within the pressure vessel for shifting between gears to vary the speed of the basket. The gears may directly connect, or may be connected by belts, chains, or the like. In the case of an electric motor, the motor shaft could serve as the basket shaft, although it is preferred that the basket not be directly supported by the motor shaft itself, and instead be connected through a suitable drive mechanism as described herein.

The motor may be an electric motor such as a canned motor, or may be a pneumatically motor or hydraulic motor, driven with a fluid separate from the cleaning fluid such as air or hydraulic fluid. A hydraulic motor may be driven with the cleaning fluid itself, although the motor would still be connected to the basket be means of a drive mechanism, rather than employing the motor shaft directly as the basket shaft, to overcome the high rotational torque required to initiate movement of the basket. In general, such motors are piston motors.

Suitable canned motors, or submersible motors, are available from Franklin Electric, Bluffton, Ind. 46714 USA. Of course, an electric line (not shown) must pass through the pressure vessel, but the sealing of a stationary electric line may be carried out in a routine manner, unlike the sealing of a rotating shaft. The motor may be supplied free of an external portion which becomes part of the pressure vessel, or may be supplied with an external portion that is fastened to the body member to become a part of the pressure vessel.

The bearing cartridge may be a cantilevered bearing cartridge, which may be comprised of ball bearings, roller bearings, sleeve bearings or any other suitable bearing system. Suitable balls for ball bearings are available from Barden Corp., 200 Park Avenue, P.O. Box 2449, Danbury, Conn., 06813-2449. Ball bearings are preferably made from a ceramic (silicon nitride). The bearing cartridge is fastened to a cartridge plate, which is in turn fastened to the back of the cartridge holder.

In general, the door is hinged on the pressure vessel and is physically closed by a person. Any suitable closing mechanism can be employed, including automatic or hydraulic closing mechanisms. In one embodiment, when the door is pushed far enough closed a relay is energized that signals to a controller that the door is ready to be locked in place. A hydraulic cylinder is energized by the controller to engage a rotating locking ring within the locking mechanism into place against wedges that press the door up against the head section of the pressure vessel. A seal is made via an O-ring that is compressed when the locking ring is moved into place. The door includes instrumentation that does not allow it to be opened until pressure is sufficiently released from the enclosed chamber formed therein.

The apparatus is preferably fabricated from a corrosion-resistant material such as stainless steel.

Articles that can be cleaned by the apparatus of the present invention are, in general, garments and fabrics (including woven and non-woven) formed from materials such as cotton, wool, silk, leather, rayon, polyester, acetate, fiberglass, furs, pelts, canvas, neoprene, etc., formed into items such as clothing, work gloves, tents, parachutes, sails, hats, tapestry, waders, rags, leather goods (e.g. boots, shoes, handbags and brief cases), etc. Of course, the present invention may be employed with other articles, such as metal parts, where tumbling during cleaning is desired.

Any liquid carbon dioxide cleaning medium may be employed in carrying out the present invention, including but not limited to those described in U.S. Pat. No. 5,858,022 to Romack et al., or U.S. Pat. No. 5,676,705 to Jureller et al. Thus the cleaning medium may consist essentially of carbon dioxide, but will typically include one or more additional ingredients such as surfactant, cosolvent, water, etc. In addition, while the apparatus is described in connection with carbon dioxide, it will be appreciated that other compressed gases can be used in combination therewith, or as a substitute therefore (applicants specifically intend that the disclosures of all United States patent references cited herein be incorporated herein by reference).

While specific apparatus is described above, it will be appreciated that the present invention can incorporate the features of other apparatus useful for dry cleaning with a liquid carbon dioxide cleaning medium, such as described in U.S. Pat. No. 1,358,168 to McCutchen, U.S. Pat. No. 1,455,378 to Allen, U.S. Pat. No. 2,357,909 to Ridge, U.S. Pat. No. 2,816,429 to Kurlancheek, U.S. Pat. No. 3,444,710 to Gaugler, U.S. Pat. No. 4,012,194 to Maffei, U.S. Pat. No. 5,467,492 to Chao et al., U.S. Pat. No. 5,669,251 to Townsend et al, U.S. Pat. No. 5,267,455 to Dewees et al., and U.S. Pat. No. 5,850,747 to Roberts and Kegler.

The foregoing is illustrative of the present invention, and is not to be construed as limiting thereof. The invention is defined by the following claims, with equivalents of the claims to be included therein.

We claim:

1. A cleaning apparatus adapted for use with a carbon dioxide cleaning medium, comprising:

a body member having a front opening formed therein, said body member having side walls and a back wall opposite said front opening, said side walls terminating in a front body member edge portion defining said front opening;

a door connected to said body member, said door having a front wall and side walls, with said side walls terminating in an inner edge portion configured to abut said body member edge portion; said body member and said door together forming an enclosed pressure vessel;

a substantially cylindrical basket disposed within said body member for rotation about a generally horizontal axis, said basket having a front opening formed therein, said basket having a side wall and a back wall opposite said front opening, said side wall terminating in a front basket edge portion defining said basket front opening;

an elongate shaft connected to said basket back wall and coincident with said axis, and a shaft support connected to said body member back wall, with said shaft disposed in said shaft support to permit rotation of said basket within said body member without said shaft penetrating through said back wall;

a motor contained within said pressure vessel; and a drive mechanism interconnecting said motor to said elongate shaft and configured to rotate said basket.

2. An apparatus according to claim 1, wherein said motor is connected to said body member back wall.

3. An apparatus according to claim 1, wherein said motor is a canned motor.

4. An apparatus according to claim 1, wherein said motor is an electric motor.

5. An apparatus according to claim 1, wherein said motor is a piston motor.

6. An apparatus according to claim 1, wherein said motor is a pneumatic motor.

7. An apparatus according to claim 1, wherein said motor is a hydraulic motor.

8. An apparatus according to claim 1, further comprising a flush line connected to said motor.

9. An apparatus according to claim 1, further comprising a flush line connected to said shaft support.

10. An apparatus according to claim 1, further comprising a fill line connected to said body member.

11. An apparatus according to claim 1, further comprising a plug connected to said door, said plug having a surface portion configured to abut said basket front opening when said door is in said closed position to permit rotation of said basket within said body member while preventing items within said basket from escaping during rotation of said basket.

12. An apparatus according to claim 1, wherein said basket is perforated.

13. An apparatus according to claim 1, wherein said basket is generally horizontal.

14. A cleaning apparatus adapted for use with a carbon dioxide cleaning medium, comprising:

a body member having a front opening formed therein, said body member having side walls and a back wall opposite said front opening, said side walls terminating in a front body member edge portion defining said front opening;

a door connected to said body member, said door having a front wall and side walls, with said side walls terminating in an inner edge portion configured to abut said body member edge portion; said body member and said door together forming an enclosed pressure vessel;

a substantially cylindrical basket disposed within said body member for rotation about a generally horizontal axis, said basket having a front opening formed therein, said basket having a side wall and a back wall opposite said front opening, said side wall terminating in a front basket edge portion defining said basket front opening;

an elongate shaft connected to said basket back wall and coincident with said axis, and a shaft support connected to said body member back wall, with said shaft disposed in said shaft support to permit rotation of said basket within said body member without said shaft penetrating through said back wall;

a motor contained within said pressure vessel;

a drive mechanism interconnecting said motor to said elongate shaft and configured to rotate said basket;

and wherein said elongate shaft does not penetrate through said pressure vessel.

15. An apparatus according to claim 14, further comprising:

a fill line connected to said body member for filling said enclosed pressure vessel with said cleaning medium;

a flush line interconnecting said fill line and said bearing support; and a filter connected to said flush line for filtering said cleaning medium before said cleaning medium enters said bearing support for flushing and lubricating said bearing support without said elongate shaft penetrating through said pressure vessel.

16. An apparatus according to claim 15, wherein said motor is a canned motor.

17. An apparatus according to claim 16, wherein said motor is an electric motor.

18. An apparatus according to claim 17, further comprising a flush line connected to said motor.

19. An apparatus according to claim 18, wherein said basket is perforated, and wherein said basket is generally horizontal.

20. An apparatus according to claim 19, further comprising a plug connected to said door, said plug having a surface portion configured to abut said basket front opening when said door is in said closed position to permit rotation of said basket within said body member while preventing items within said basket from escaping during rotation of said basket.

* * * * *